US005967235A

United States Patent [19]

Scott

[11] Patent Number: 5,967,235

[45] Date of Patent: Oct. 19, 1999

[54] WELLHEAD UNION WITH SAFETY INTERLOCK

[75] Inventor: Bruce E. Scott, Plano, Tex.

[73] Assignee: Halliburton Energy Services, Inc., Dallas, Tex.

[21] Appl. No.: 08/834,670

[22] Filed: Apr. 1, 1997

[51] Int. Cl.[6] ..... E21B 33/02

[52] U.S. Cl. ..... 166/379; 166/75.13; 166/95.1; 166/135

[58] Field of Search ..... 166/75.13, 97.1, 166/95.1, 379, 75.11, 88.1, 238, 212, 135, 192

[56] References Cited

U.S. PATENT DOCUMENTS

| | | | |
|---|---|---|---|
| 1,367,156 | 2/1921 | McAlvay et al. | 166/75.13 |
| 1,735,330 | 11/1929 | McMahan | 166/95.1 |
| 1,822,444 | 9/1931 | MacClatchie | 166/75.13 |
| 2,297,415 | 9/1942 | Johnson | 166/212 |
| 2,536,431 | 1/1951 | Endsley | 166/75.13 |
| 2,605,847 | 8/1952 | McCoy | 166/54 |
| 2,884,071 | 4/1959 | Fredd | 166/137 |
| 3,860,067 | 1/1975 | Rodgers | 166/121 |
| 5,000,719 | 3/1991 | Reed | 166/378 |
| 5,168,933 | 12/1992 | Pritchard, Jr. et al. | 166/348 |
| 5,437,309 | 8/1995 | Timmons | 166/192 |
| 5,509,476 | 4/1996 | Vick, Jr. | 166/75.13 |

*Primary Examiner*—Hoang C. Dang
*Attorney, Agent, or Firm*—Paul I. Herman; J. Richard Konneker

[57] ABSTRACT

A wellhead union and associated methods provide enhanced safety in operations involving access to, and/or fluid communication with, a wellhead. In a described embodiment, a wellhead union has a housing structure which includes a fluid conduit and a plug. A safety interlock prevents removal of the plug from the fluid conduit when fluid pressure is present within the wellhead. As a warning that such fluid pressure is present within the wellhead, the safety interlock additionally provides an externally visible indication when the fluid pressure is present.

42 Claims, 4 Drawing Sheets

WELLHEAD UNION WITH SAFETY INTERLOCK

BACKGROUND OF THE INVENTION

The present invention relates generally to operations associated with wellheads on subterranean wells and, in an embodiment described herein, more particularly provides a wellhead union having a safety interlock.

External access to a wellhead is typically provided by a wellhead union, or "quick union", attached to an upper portion of the wellhead. The union generally consists of a plug sealingly inserted into the interior of a fluid conduit, with the plug maintained in place by a cap threadedly attached to the fluid conduit. In order to gain access to the wellhead, it is normal practice to close a master valve of the wellhead, bleed off any fluid pressure within the wellhead, unthread and remove the cap, and then remove the plug from the fluid conduit.

It will be readily appreciated that, if the fluid pressure in the wellhead is greater than atmospheric pressure at the time the cap is removed, the plug, and possibly the cap, may be violently and uncontrollably propelled from the wellhead. This extremely hazardous condition may easily result in damage of property or loss of life. Even more hazardous conditions are presented when caustic, acidic, or otherwise harmful substances, such as hydrogen sulfide gas, are present in the wellhead at the time the cap is removed.

While the normal practice is to bleed off the fluid pressure within the wellhead before removing the cap, an operator may forget this step, or the operator may attempt to bleed off the pressure but the attempt may fail. One reason that the attempt may fail is that a valve used to bleed off the pressure may become blocked with scale or other debris. Another reason is that a pressure gauge used to indicate fluid pressure within the wellhead may be inaccurate, improperly functioning, or may also be blocked by debris, etc. Thus, an operator, even though he or she may have attempted to bleed off the fluid pressure within the wellhead, still cannot be assured that it has been completely, or partially, bled off.

When the cap is unthreaded from the fluid conduit in ideal conditions, and fluid pressure is present within the wellhead, the cap may be difficult to rotate. This is due to the plug being forced against the cap by the fluid pressure. An operator may recognize that difficulty in rotating the cap may be associated with the presence of fluid pressure, or the operator may equate this difficulty with damaged threads, inadequate leverage, or other possible causes of the difficulty. Additionally, the cap may be unthreaded without difficulty even in the presence of fluid pressure within the wellhead, due to the plug being temporarily stuck in the fluid conduit. Thus, no positive indication of the presence of the fluid pressure within the wellhead is provided.

Although the above discussion has been directed to surface wellheads, it will be readily appreciated that similar problems and hazards exist in association with subsea wellheads. Access to a subsea wellhead is complicated by the fact of its remote location, which also adds to the variety of problems that may be encountered in bleeding off fluid pressure within the wellhead.

From the foregoing, it can be seen that it would be quite desirable to provide a wellhead union which permits convenient access to, fluid communication with, and attachment of other items of equipment to, a wellhead, while preventing such access, fluid communication and attachment when fluid pressure is present within the wellhead. It would also be quite desirable to provide a wellhead union which gives a positive indication of the presence of fluid pressure within the wellhead. It is accordingly an object of the present invention to provide such a wellhead union and methods associated therewith.

SUMMARY OF THE INVENTION

In carrying out the principles of the present invention, in accordance with an embodiment thereof, a wellhead union is provided which includes a safety interlock. The safety interlock operates in response to fluid pressure within a wellhead to which the wellhead union is attached. The safety of operations associated with the wellhead is enhanced by the fact that it is the presence of fluid pressure in the wellhead, which is the main source of potentially hazardous conditions, that activates the safety interlock. Associated methods are also provided.

In broad terms, an apparatus is provided for use with a wellhead associated with a subterranean well. The apparatus includes an activation member which is configured to displace in response to fluid pressure within the wellhead. When the activation member displaces, it causes an engagement member to engage a fluid conduit attached to the wellhead.

A plug blocks fluid flow through the fluid conduit. The engagement member is attached to the plug, so that when the engagement member engages the fluid conduit, the plug is prevented from being removed from the fluid conduit. In this manner, fluid is prevented from escaping from the wellhead under pressure.

In another aspect of the present invention, an apparatus is provided which indicates the presence of fluid pressure within a wellhead. This indication of fluid pressure provides a warning to persons performing operations about the wellhead. The apparatus includes an indicator member disposed at least partially within a housing structure attached to the wellhead.

The housing structure has an opening formed therethrough, and the indicator member is capable of displacing relative to the opening. When fluid pressure is present within the wellhead, the indicator member displaces relative to the opening and provides an externally visible indication of the presence of the fluid pressure. In a representatively illustrated embodiment of the invention, the indicator member protrudes through the opening, such that a portion of the indicator member is external to the housing structure, when the fluid pressure is present.

In yet another aspect of the present invention, an apparatus is provided which prevents disassembly of a pressure-containing housing structure. The housing structure is attachable to a wellhead and has an activation member disposed at least partially therein. The activation member displaces in response to fluid pressure within the wellhead to prevent disassembly of an assembly of multiple members included in the housing structure.

When fluid pressure is present within the wellhead, the activation member displaces relative to the housing structure. In a representatively illustrated embodiment of the present invention, displacement of the activation member causes corresponding displacement of an engagement member attached to one of the housing structure members. When the engagement member displaces, it engages another one of the housing structure members, thereby preventing displacement of each of the housing structure members relative to the other one of them.

Methods associated with the disclosed apparatus are also provided. In particular, methods of using the apparatus to prevent access to a fluid pressure-containing wellhead, of indicating the presence of fluid pressure within the wellhead, of preventing disassembly of a fluid pressure-containing housing structure attached to the wellhead, and of attaching items of equipment to the wellhead are disclosed.

In a disclosed method of attaching an item of equipment to the wellhead, an interlock is activated by fluid pressure within the wellhead. When activated, the interlock prevents displacement of a plug relative to a fluid conduit to which the item of equipment is to be attached. Thus, the plug may not be removed to provide access and fluid communication with the wellhead while fluid pressure is present within the wellhead.

The interlock may be deactivated in a number of ways in order to permit removal of the plug and attachment of the item of equipment to the wellhead. A biasing member may be provided to bias the interlock to a deactivated configuration upon release of the fluid pressure from the wellhead, a force may be applied to a portion of the interlock which is externally accessible, or fluid pressure may be applied to a port formed through the plug, in order to displace the interlock to its deactivated configuration.

These and other aspects, features, benefits and objects of the present invention will become apparent upon careful consideration of the detailed description hereinbelow of a representative embodiment of the present invention and the accompanying illustrations.

DETAILED DESCRIPTION

Figure 1:
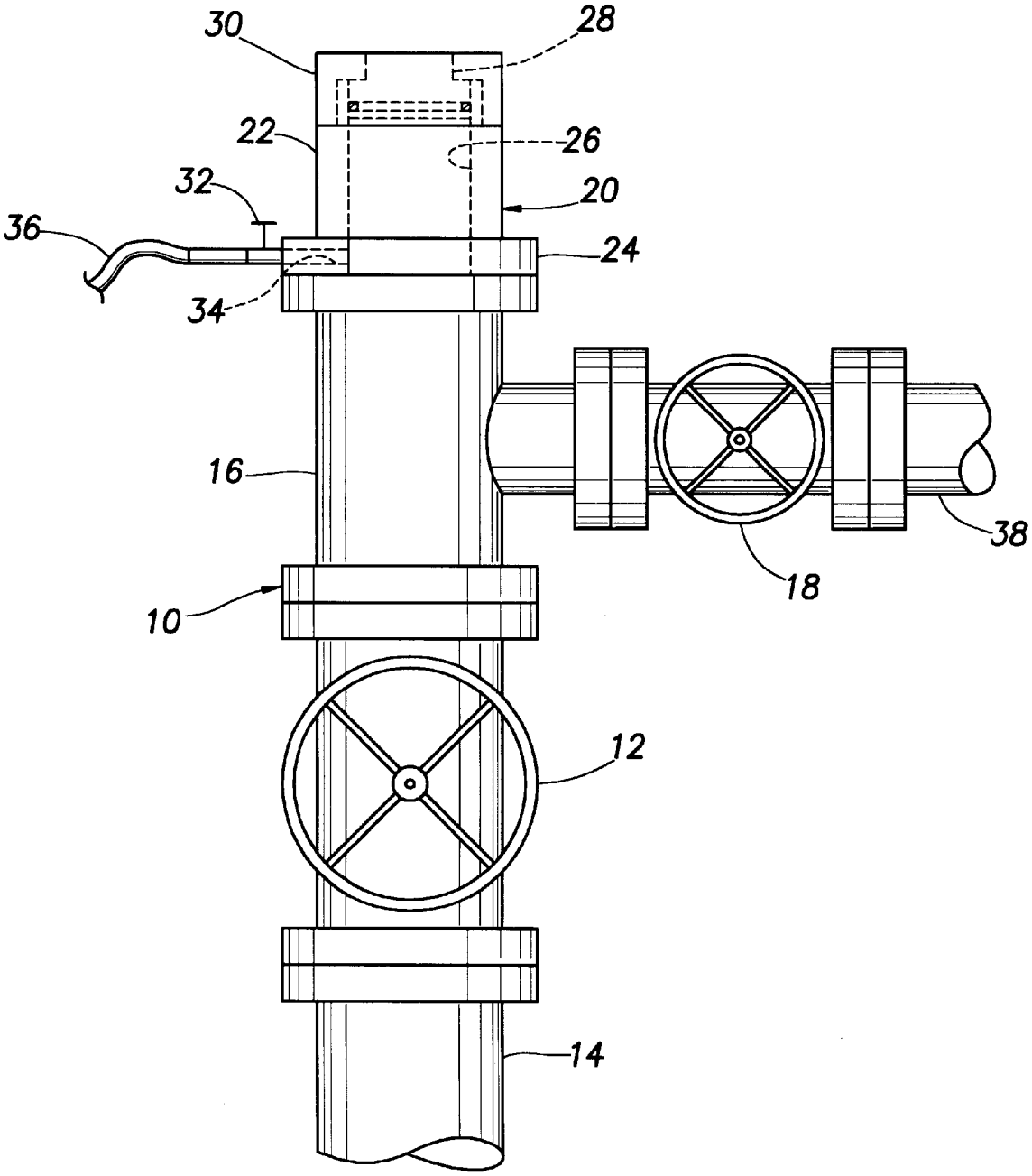
FIG. 1 is an elevational view of a wellhead having a union installed thereon.

Schematically and representatively illustrated in FIG. 1 is a wellhead 10. In the following description of the wellhead 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The wellhead 10 is representatively illustrated as having a master valve 12 interconnected to a surface conductor pipe 14 and a flanged tee connector 16, to which a side valve or choke 18 is connected. However, it is to be understood that wellheads having various configurations, including subsea wellheads, may be used in place of the representatively illustrated wellhead 10 without departing from the principles of the present invention. For example, the wellhead 10 may instead include substituted or alternate valves, chokes, other flow control devices, threaded connections instead of flanged connections, the wellhead may be substantially integrally formed instead of being made up of individual elements, etc.

A wellhead union 20 is attached to the wellhead 10 and, in a sense, becomes a part of the wellhead. Other terms used to describe a wellhead union may include "adaptor" (in view of the fact that a wellhead union may, for example, serve to adapt a threaded connection on another item of equipment to a flanged connection on a wellhead), "quick union" (in view of the fact that other items may be quickly connected to a wellhead through the use of a wellhead union) and "top connector" (in view of the fact that a wellhead union may be installed as the uppermost component on a wellhead). It is to be understood that use of the term "wellhead union" herein is not intended, and is not to be taken, as a limited description of the functional capabilities or characteristics of the various embodiments of the invention disclosed herein, rather the term is to be given its broadest reasonable interpretation.

The wellhead union 20 representatively illustrated in FIG. 1 includes a fluid conduit 22, which is attached to the wellhead 10 at a flanged connection 24. The fluid conduit 22 has an interior flow passage 26 formed axially therethrough, and the flow passage is in fluid communication with the interior of the wellhead 10. Thus, when fluid pressure is present within the wellhead 10, it is also present within the flow passage 26.

A plug 28 is installed in the flow passage 26 and sealingly engages the fluid conduit 22, so that fluid pressure within the wellhead 10 is blocked from exhausting to the atmosphere via the flow passage. A collar or cap 30 is threadedly connected to the fluid conduit 22, in order to prevent the plug 28 from being expelled from the flow passage 26 by fluid pressure within the wellhead 10.

A relatively small valve, representatively a needle valve 32, is connected to the flanged connection 24. The valve 32 is in fluid communication with the flow passage 26 via a port 34 formed radially through the flanged connection 24. The valve 32 may be used to provide selective fluid communication between the interior of the wellhead 10 and the atmosphere via piping or hose 36, if any, connected to the valve 32.

To gain access to the interior of the wellhead 10, for example, to gain access to the interior of a subterranean well with which the wellhead is associated, the plug 28 is removed from the fluid conduit 22. To remove the plug 28, the master valve 12 is closed, thereby isolating the interior of the wellhead 10 above the master valve from the remainder of the well. If pipe 38 attached to the valve or choke 18 does not contain atmospheric pressure, or if other reasons dictate that it not be left open, the valve 18 is also closed. The valve 32 is opened to exhaust any fluid pressure remaining in the wellhead 10 to the atmosphere, or to otherwise reduce the pressure within the wellhead to atmospheric pressure.

The cap or collar 30 is then unthreaded from the fluid conduit 22. At this point, the plug may be removed from the fluid conduit 22 by, for example, attaching a lifting eye (not shown) to it and lifting it free from the wellhead union 20. With the plug 28 thus removed, access is provided to the interior of the wellhead 10, and fluid communication with the interior of the wellhead may be established by installing appropriately configured members in place of the plug, and other items of equipment, such as wireline or slickline lubricators, or coiled tubing devices, may be attached to the fluid conduit 22.

Figure 2:
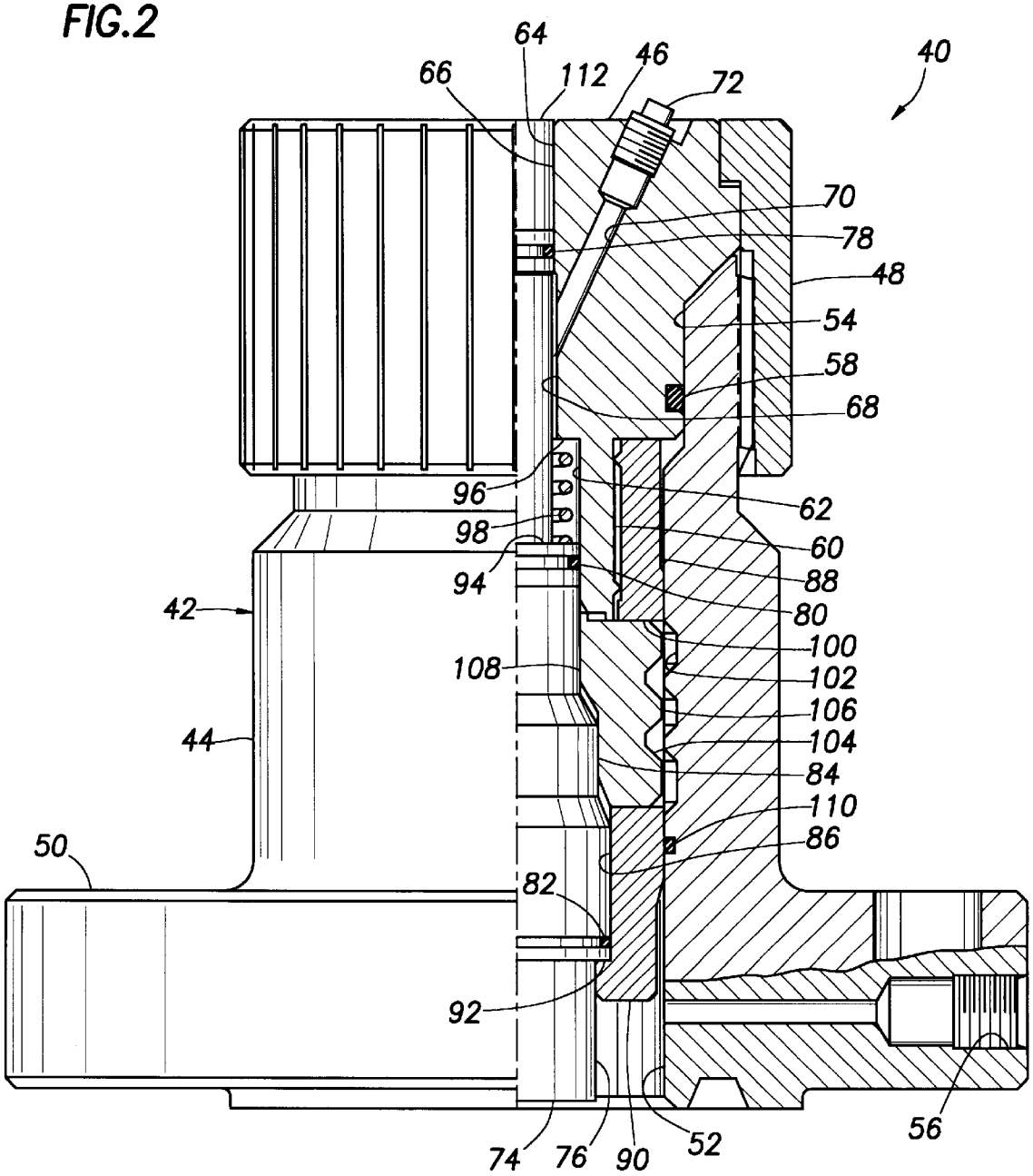
FIG. 2 is an enlarged scale partially elevational and partially cross-sectional view of a wellhead union incorporating a safety interlock, the safety interlock being shown in a deactivated configuration, the wellhead union and safety interlock embodying principles of the present invention.

Referring additionally now to FIG. 2, a wellhead union 40 embodying principles of the present invention is representatively illustrated. The wellhead union 40 may be used for the wellhead union 20 shown in FIG. 1. However, it is to be understood that the wellhead union 40 may be used on a variety of differently configured wellheads, including subsea wellheads, without departing from the principles of the present invention. It is also to be understood that optional features and elements of the wellhead union 40 may be shown in the accompanying figures, but these features and elements are not necessary in a wellhead union made and utilized in accordance with the principles of the present invention. Additionally, the wellhead union 40 described herein and representatively illustrated in the accompanying figures may include unique subassemblies thereof, which may be used in other apparatus without departing from the principles of the present invention.

The wellhead union 40 includes a housing structure 42. When the wellhead union 40 is operatively attached to a wellhead, such as the wellhead 10, the housing structure 42 is capable of containing fluid pressure within the wellhead. For this purpose, among others, the housing structure 42 includes a fluid conduit or flange adaptor 44 and a blanking plug 46. The plug 46 is secured to the flange adaptor 44 by means of an internally threaded collar 48.

The flange adaptor 44 includes a lower flange 50, an internal axial flow passage 52, and an internal axially extending seal bore 54. Of course, the flange 50 may readily be replaced by a threaded connection, or by other means of sealingly attaching the housing structure 42 to a wellhead. A port 56 is formed radially through the flange 50, intersecting the flow passage 52, and is provided with internal threads for connection of, for example, a valve, such as valve 32, thereto.

The plug 46 carries a circumferential seal 58 externally thereon, which sealingly engages the seal bore 54. A downwardly extending, generally tubular shaped portion 60 of the plug 46 has an axially extending seal bore 62 formed internally thereon. An axially extending opening 64 is formed generally centrally through the plug 46. An upper portion of the opening 64 is a seal bore 66, and a lower portion is a somewhat radially enlarged bore 68. A port 70 is formed through the plug 46, intersecting the bore 68. A plug 72 is threadedly and sealingly installed in the port 70.

Axially slidingly received within the plug 46 is a key expander 74 which, as will be more fully described hereinbelow, serves as an activation member, indicator member and pressure responsive member in the wellhead union 40. In an important aspect of the present invention, the key expander 74 displaces in response to fluid pressure in the flow passage 52 (and, thus, to fluid pressure within a wellhead to which the wellhead union 40 is operatively attached) to prevent removal of the plug 46 from the flange adaptor 44, prevent disassembly of the housing structure 42, and provide an indication of the presence of fluid pressure.

An external surface 76 of the key expander 74 carries axially spaced apart circumferential seals 78, 80, 82 externally thereon. Certain of these seals are optional as will be more fully described hereinbelow. The surface 76 has an external profile 84 formed thereon which includes one or more inclined portions. The seal 78 is sealingly received in the seal bore 66, the seal 80 is sealingly received in the seal bore 62, and the seal 82 is sealingly received in an axially extending seal bore 86 formed internally on a generally tubular key retainer 88.

The key retainer 88 is threadedly attached to the plug portion 60. It extends downwardly from the portion 60 within the flow passage 52, partially radially outwardly overlying the key expander 74. A radially inwardly extending portion 90 of the key retainer 88 axially contacts a downwardly facing external shoulder 92 formed on the key expander surface 76 to prevent further downward displacement of the key expander 74 relative to the key retainer.

Axially upward displacement of the key expander 74 is limited by an upwardly facing external shoulder 94 formed on the surface 76 and a downwardly facing internal shoulder 96 formed on the plug 46. An optional biasing member or spring 98 is installed in an annular space axially between the shoulders 94, 96 and radially between the key expander 74 and the seal bore 62. The spring 98 applies an axially downwardly directed force to the key expander 74 to maintain the shoulder 92 in contact with the portion 90. Other biasing members, such as resilient members, gas springs, etc., may be utilized in place of, or in addition to, the spring 98, and may be otherwise positioned within the wellhead union 40, without departing from the principles of the present invention.

The key retainer 88 has a series of circumferentially spaced apart apertures 100 formed radially therethrough, only one of which is visible in FIG. 2. The apertures 100 are positioned radially opposite a circumferential profile 102 formed internally on the flange adaptor 44. The profile 102 is representatively illustrated as a series of axially spaced apart annular recesses or grooves, but it is to be understood that other shapes of profiles may be utilized without departing from the principles of the present invention.

A series of circumferentially spaced apart engagement members or keys 104 (only one of which is visible in FIG. 2) are radially slidingly received in the apertures 100, each of the keys being received in a corresponding one of the apertures. Each of the keys 104 has an external profile 106 formed externally thereon which is complementarily shaped relative to the profile 102. As representatively illustrated in FIG. 2, the keys 104 are radially inwardly disposed and do not engage the profile 102, but it will be readily appreciated that if the keys are radially outwardly displaced, the profiles 106 will engage the profile 104 and thereby prevent axial displacement of the key retainer 88 relative to the flange adaptor 44.

Note that the keys 104 are axially restrained by the key retainer 88 against axial displacement relative to the plug 46. In this sense, the keys 104 are attached to the plug 46, but are permitted to displace radially relative to the plug. Other engagement members may be utilized in place of the keys 104 without departing from the principles of the present invention, for example, one or more balls could be radially slidingly received in the apertures 100 for engagement with a semicircular recess formed as the profile 102, collets may be secured to the plug 46 (in which case the key retainer may be eliminated), a conventional RATCH LATCH® manufactured by, and available from, Halliburton Company of Duncan, Okla. may be used (in which case the complementarily shaped profiles 102, 106 may be threads), a C-ring or snap ring could be used, etc.

Each of the keys 104 also has a profile 108 formed internally thereon. The profiles 108 are configured for cooperative engagement with the profile 84 formed externally on the key expander surface 76. As representatively illustrated, the profiles 108 include inclined surfaces complementarily shaped relative to inclined surfaces formed on the profile 84, but it is to be understood that other configurations of the profiles 108, 84 may be utilized without departing from the principles of the present invention.

A circumferential seal 110 is carried internally on the flange adaptor 44. The seal 110 sealingly engages the key retainer 88 and, in cooperation with the seal 82 prevents fluid and debris from contacting the keys 104. It will also be readily appreciated that the seal 82 presents a relatively large piston area for upward axial displacement of the key expander 74 in response to fluid pressure within the flow passage 52. It is to be understood, however, that the seals 82, 110 are not necessary in the wellhead union 40 in accordance with the principles of the present invention, since the seal 80 would present a piston area, and the seal 78 would present a piston area if the seal 80 were not in place, for axial displacement of the key expander 74 in response to fluid pressure in the flow passage 52, in the absence of the seals 82, 110. The applicants, however, utilize the seals 82, 110 to provide a relative large axial force applied to the key expander 74 in response to fluid pressure in the flow passage 52, and to isolate the keys 104 from fluid and debris which may be present in a wellhead to which the wellhead union 40 is attached.

As representatively illustrated in FIG. 2, the wellhead union 40 is in a configuration in which the plug 46, key expander 74, keys 104 and key retainer 88 may be conveniently removed from the flow passage 52. In order to remove these components, the collar 48 is unthreaded from the flange adaptor 44 and removed therefrom. The plug 46, key expander 74, keys 104 and key retainer 88 may then be lifted upwardly and removed from the flange adaptor 44. For subsea applications, the plug 46 may be fitted with a conventional fishing neck (not shown) or other device to allow it to be removed and/or installed via wireline, slickline or coiled tubing. For surface applications, a lifting eye or similar device may be attached to the plug 46 if desired.

It will be readily appreciated by one of ordinary skill in the art that if fluid pressure is present in the flow passage 52 below the seals 82, 110, the key expander 74 will be biased upwardly by that fluid pressure. The biasing force exerted by the fluid pressure will axially upwardly displace the key expander 74 relative to the remainder of the wellhead union 40. Of course, if the optional spring 98 is installed, the biasing force exerted by the fluid pressure must exceed the biasing force exerted by the spring for the key retainer 74 to displace upwardly.

When the key retainer 74 displaces upwardly, the inclined surfaces on the key retainer external profile 84 will contact the inclined surfaces on the key internal profiles 108, thereby causing the keys 104 to radially outwardly displace relative to the remainder of the wellhead union 40. Ultimately, when the keys 104 have sufficiently outwardly displaced, their external profiles 106 will engage the internal profile 102 of the flange adaptor 44. Such engagement of the keys 104 with the flange adaptor 44 prevents axial displacement of the plug 46 relative to the flange adaptor and, thus, prevents removal of the plug from the flow passage 52. In this manner, the key expander 74, key retainer 88 and keys 104 act as a safety interlock to prevent removal of the plug 46 from the flow passage 52 when fluid pressure is present in the flow passage 52.

Figure 3:
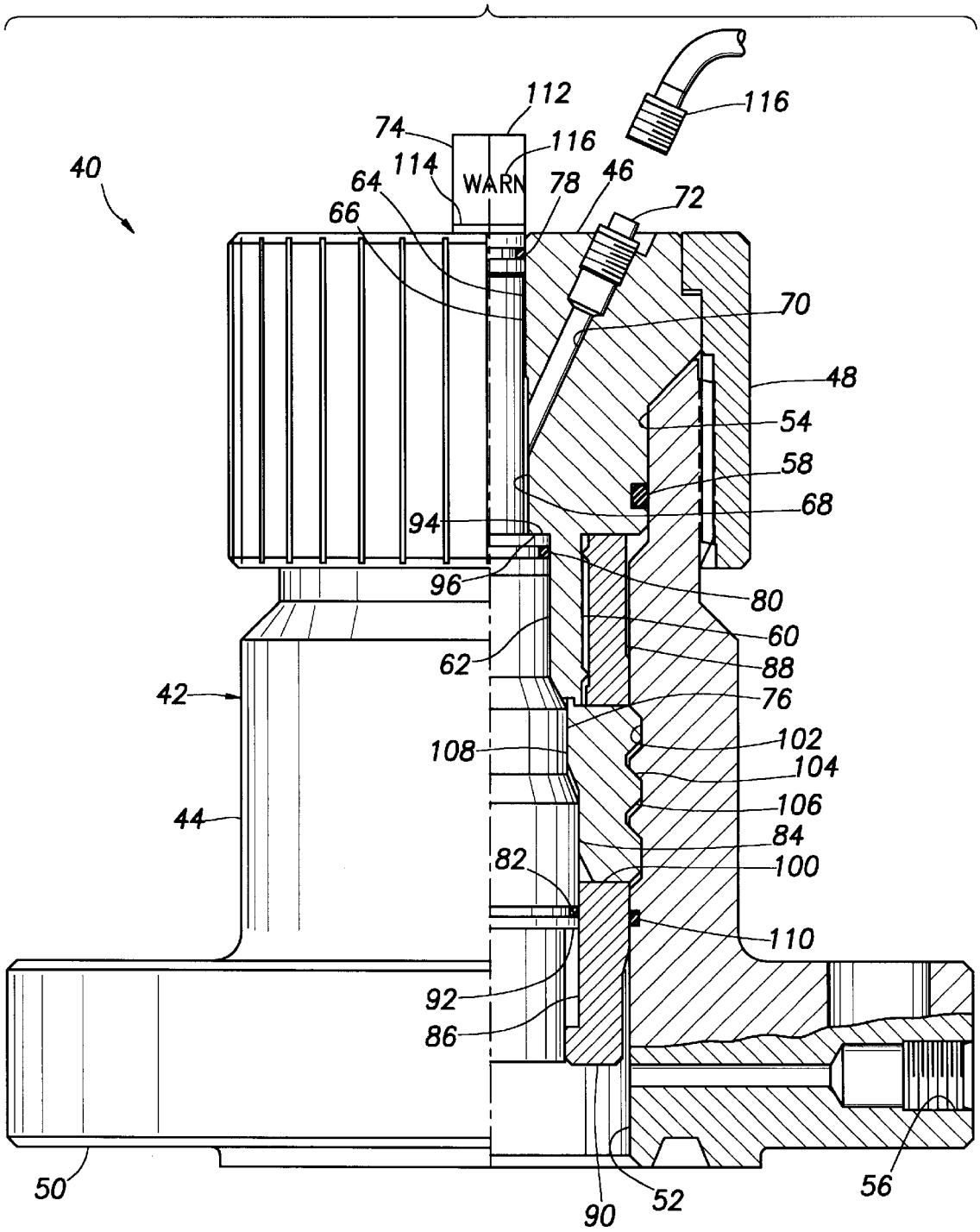
FIG. 3 is an enlarged scale partially elevational and partially cross-sectional view of the wellhead union and safety interlock of FIG. 3, the safety interlock being shown in an activated configuration.

Referring additionally now to FIG. 3, the wellhead union 40 is representatively illustrated in a configuration in which the key expander 74 has been axially upwardly displaced relative to the remainder of the wellhead union, thereby radially outwardly displacing the keys 104 into cooperative engagement with the flange adaptor 44. Thus, in this configuration the plug 46 is prevented from being removed from the flow passage 52. As described above, such upward displacement of the key expander 74 may be caused by fluid pressure within the flow passage 52. Alternatively, if it is desired to have the safety interlock normally activated without requiring fluid pressure in the flow passage 52, a biasing member, such as a compression spring similar to the spring 98 (not shown in FIG. 3, see FIG. 2), could be installed to exert an upwardly biasing force on the key expander 74. For example, a spring could be installed i n the annular space axially between the shoulder 92 and the portion 90 and radially between the external surface 76 and the seal bore 86, with the space being appropriately configured to receive the spring therein.

Note that an upper portion 112 of the key expander 74 now extends outwardly through the opening 64 where it is plainly externally visible. In an important aspect of the present invention, the portion 112 provides an indication that fluid pressure is present within the flow passage 52 and, therefore, provides a warning against attempting to remove the plug 46 from the flange adaptor 44. To enhance this indication of possible danger, the portion 112 may have a mark, such as a groove 114, formed thereon, text 116 or a symbol written thereon, color applied thereto, etc.

Note also that the displacement of the key expander 74 relative to the opening 64 may be otherwise utilized without departing from the principles of the present invention. For example, the collar 48 may extend radially inward above the plug 46, thereby forming a cap over the plug, and the key expander portion 112 may engage a complementarily shaped portion of the collar when the key expander 74 is upwardly displaced, to thereby prevent unthreading of the collar from the flange adaptor 44 when fluid pressure is present in the flow passage 52. Thus, in this additional or substitute manner, displacement of the key expander 74 may be used to prevent disassembly of the various elements of the wellhead union 40.

To deactivate the safety interlock when it is desired to gain access to the flow passage 52 and the wellhead to which the wellhead union 40 is attached, the key expander 74 is axially downwardly displaced to its position as shown in FIG. 2. This may be accomplished in a variety of ways, however, any fluid pressure in the flow passage 52 should be exhausted to the atmosphere before downward displacement of the key expander 74 is attempted, for example, by opening a valve connected to the port 56. In one way of deactivating the safety interlock, the spring 98 or other biasing member (not shown in FIG. 3, see FIG. 2) biases the key expander 74 axially downward when the fluid pressure in the flow passage 52 is reduced to a sufficiently low level. In another way of deactivating the safety interlock, a downwardly directed force is applied to the portion 112 of the key expander 74 which extends outwardly from the opening 64.

In a third way of deactivating the safety interlock, the plug 72 is unthreaded and removed from the plug 46, and a connector 116 from a fluid pressure source, such as a hydraulic pump (not shown), is sealingly secured in place of the plug 72. Fluid pressure is applied through the connector 116 and transmitted via the port 70 to an annular space radially between the key expander 74 and the bore 68. It will be readily appreciated by one of ordinary skill in the art that such applied fluid pressure will apply a downwardly directed force to a differential piston area radially between the seal bore 62 and the seal bore 66.

With the key expander 74 in its downwardly displaced position, the keys 104 may be radially inwardly retracted out of engagement with the flange adaptor internal profile 102. Retraction of the keys 104 may be accomplished by applying an upwardly directed force to the plug 46, as is done when removing the plug from the flange adaptor 44, to thereby cause inclined surfaces on the key external profiles 106 to contact inclined surfaces on the flange adaptor internal profile 102. Alternatively, each of the keys 104 may be radially inwardly biased by a biasing member, such as a compression spring (not shown). Additionally, or as another alternative, where other engagement members, such as collets attached to the plug 46, are utilized in place of the keys 10,4 and key retainer 88, the engagement members themselves may provide a radially inwardly directed force due to elastic deformation thereof.

Thus has been described the wellhead union 40 which responds to fluid pressure therein to thereby prevent access to, and fluid communication with, the flow passage 52 when such fluid pressure is present, which provides an indication that the fluid pressure is present, and which prevents disassembly of components of the wellhead union when such fluid pressure is present. Of course, modifications, substitutions, additions, deletions, etc., may be made to the wellhead union 40, which changes would be obvious to a person of ordinary skill in the art, and such changes are contemplated by the principles of the present invention. For example, the plug 72, port 70, and seals 78, 80 may be eliminated if the capability of applying fluid pressure to deactivate the safety interlock is not desired. The plug 72 may be replaced with a plug having a porous portion to permit fluid to pass therethrough while excluding debris from the port 70. The plug 46 and key retainer 88 may be integrally formed. The portion 90 of the key retainer 88 could be threadedly attached to the remainder of the key retainer, or could be replaced with a snap ring. The key expander external profile 84 could be substantially all inclined and/or could be provided with serrations, etc. If a RATCH LATCH® is used in place of the keys 104 and key retainer 88, presence of the fluid pressure in the flow passage 52 could be used to prevent unthreading of the RATCH LATCH®. The key expander 74 could cooperatively engage the keys 104 to urge the keys radially inward when the key expander is downwardly displaced to deactivate the safety interlock. The key expander 74 may otherwise displace relative to the remainder of the wellhead union 40, such as laterally instead of axially, and may otherwise displace relative to the opening 64, such as across the opening instead of through it. These and many other changes may be made to the wellhead union 40 without departing from the principles of the present invention.

Figure 4:
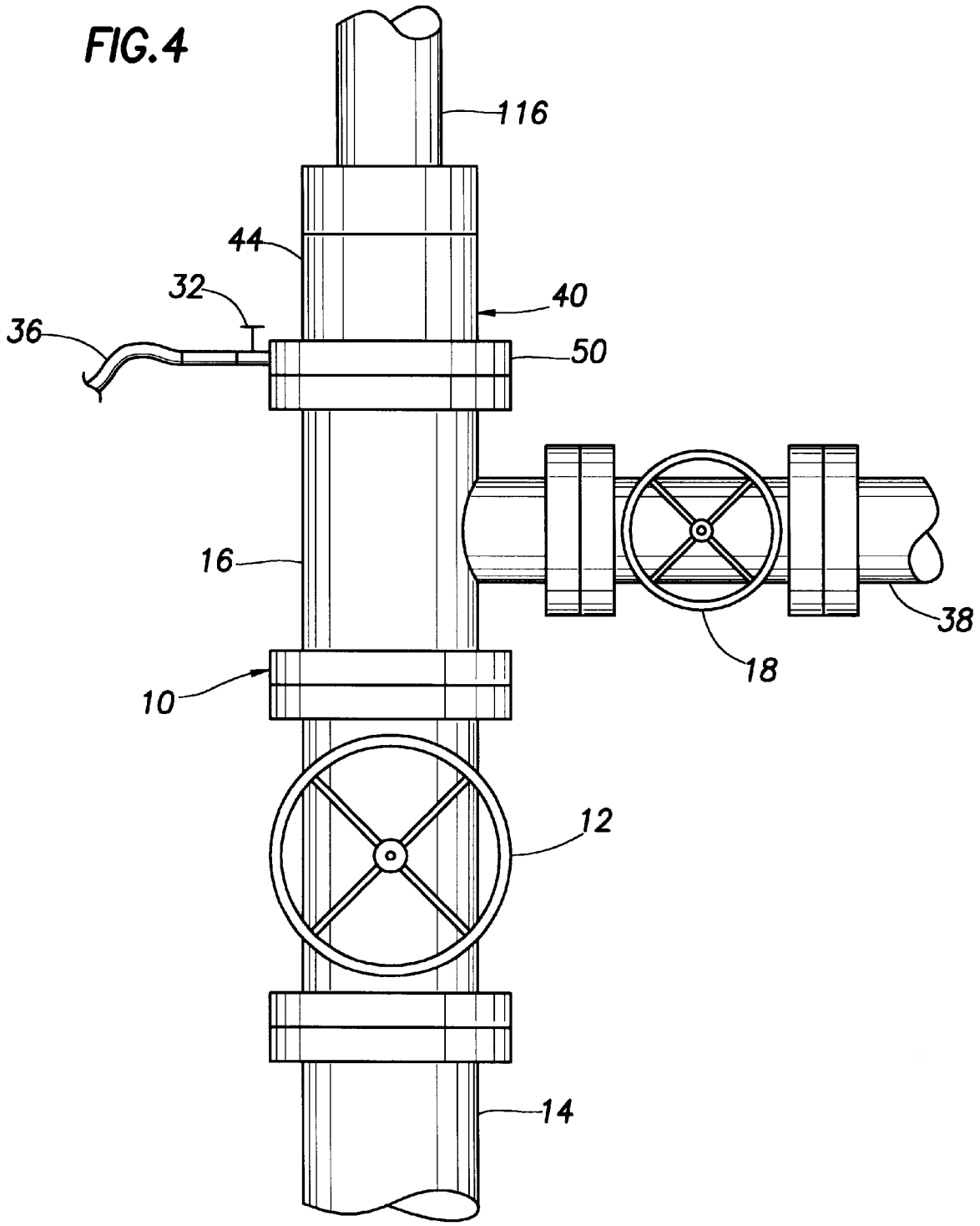
FIG. 4 is an elevational view of the wellhead of FIG. 1, with the wellhead union of FIG. 2 operatively installed thereon, and with other equipment operatively coupled to the wellhead union.

Referring additionally now to FIG. 4, the wellhead 10 of FIG. 1 is representatively illustrated with the wellhead union 40 operatively installed thereon. An item of equipment, representatively a conventional wireline lubricator 116, is attached to the wellhead union 40 to thereby permit wireline tools, etc. to be transported through the flow passage 52 and interior of the wellhead 10, and to permit fluid communication therewith. Prior to attachment of the wireline lubricator 116, the plug 46, key expander 74, key retainer 88 and keys 104 have been removed from the flange adaptor 44 as described hereinabove.

It will be readily appreciated by a person of ordinary skill in the art that the unique construction and functional capabilities of the wellhead union 40 enhance the safety of such operations in that the plug 46 is prevented from being removed from the flange adaptor 44 while fluid pressure is present within the wellhead 10. Furthermore, the wellhead union 40 provides an indication of the presence of the fluid pressure therein, so that an operator should not even attempt to attach an item of equipment, such as the lubricator 116, to the wellhead union without first ensuring that the fluid pressure is relieved and then deactivating the safety interlock.

The foregoing detailed description is to be clearly understood as being given by way of illustration and example only, the spirit and scope of the present invention being limited solely by the appended claims.

What is claimed is:

1. Apparatus operatively insertable into a fluid conduit associated with a subterranean well, the apparatus comprising:

a housing having the fluid conduit formed therein, the housing being externally attachable to a wellhead of the well;

a plug sealingly engageable with the interior of the fluid conduit to thereby block fluid flow therethrough;

an engagement member attached to the plug and displaceable relative thereto, the engagement member being capable of engaging the fluid conduit to thereby prevent displacement of the plug relative to the fluid conduit; and an activation member disposed adjacent the engagement member, the activation member displacing the engagement member to engage the fluid conduit in response to a difference between fluid pressure within the fluid conduit and pressure external to the housing.

2. The apparatus according to claim 1, wherein the fluid conduit includes a recess formed internally thereon, and wherein the engagement member is capable of engaging the recess in response to displacement of the activation member.

3. The apparatus according to claim 2, wherein the engagement member is radially outwardly displaceable relative to the activation member in response to axial displacement of the activation member.

4. The apparatus according to claim 1, wherein the plug includes an opening formed therethrough, and wherein the activation member is slidingly disposed at least partially within the opening.

5. The apparatus according to claim 4, wherein the activation member is positionable relative to the opening in a selected one of first and second positions, the activation member projecting outwardly through the opening in the first position.

6. The apparatus according to claim 5, wherein the activation member displaces the engagement member to engage the fluid conduit when the activation member displaces from the second position to the first position.

7. The apparatus according to claim 5, wherein the engagement member is a key, the key being complementarily shaped relative to an annular recess formed internally on the fluid conduit.

8. The apparatus according to claim 7, further comprising a key retainer attached to the plug, and wherein the key is radially slidingly received within an aperture formed through a sidewall portion of the key retainer.

9. The apparatus according to claim 1, wherein the activation member is slidingly received in the plug.

10. The apparatus according to claim 9, wherein the plug has a port formed therein, wherein the activation member is displaceable in a first direction relative to the plug in response to fluid pressure within the fluid conduit, and wherein the activation member is displaceable in a second direction opposite to the first direction in response to fluid pressure in the port.

11. The apparatus according to claim 1, wherein the activation member displaces in a first direction in response to fluid pressure within the fluid conduit, and further comprising a biasing member disposed proximate the activation member, the biasing member biasing the activation member in a second direction opposite to the first direction.

12. Apparatus operatively connectable to a wellhead, the apparatus comprising:

a housing structure externally accessibly attachable to the wellhead and capable of containing fluid pressure within the wellhead, the housing structure including an assembly of multiple members; and an activation member at least partially disposed within the housing structure, the activation member being displaceable relative to the housing structure to thereby selectively permit and prevent disassembly of the assembly of multiple members in response to the fluid pressure within the wellhead.

13. The apparatus according to claim 12, wherein the housing structure includes a plug and a fluid conduit, the plug being sealingly received in the fluid conduit.

14. The apparatus according to claim 13, further comprising an engagement member attached to the plug, the engagement member being capable of selectively engaging and disengaging from the fluid conduit in response to displacement of the activation member.

15. The apparatus according to claim 14, wherein the plug is prevented from displacement relative to the fluid conduit when the engagement member is engaged with the fluid conduit.

16. The apparatus according to claim 12, wherein the housing structure includes an opening formed therethrough, and wherein the activation member is slidingly disposed relative to the opening.

17. The apparatus according to claim 16, wherein the activation member is capable of providing an externally visible indication of the presence of the fluid pressure within the wellhead by displacing relative to the opening when the fluid pressure is present within the wellhead.

18. A method of preventing access to a wellhead containing fluid pressure, the method comprising the steps of:

providing an interlock responsive to fluid pressure within the wellhead;

providing a plug capable of blocking access to the wellhead;

attaching the plug to the interlock; and attaching the assembled plug and interlock within a housing externally attached to the wellhead.

19. The method according to claim 18, wherein the interlock providing step comprises providing a pressure responsive member and a lock member, the pressure responsive member being displaceable in response to the fluid pressure within the wellhead, and the lock member being displaceable in response to displacement of the pressure responsive member.

20. The method according to claim 19, wherein the step of attaching the plug to the interlock comprises attaching the lock member to the plug.

21. The method according to claim 20, wherein the step of attaching the lock member to the plug comprises preventing axial displacement of the lock member relative to the plug while permitting radial displacement of the lock member relative to the plug.

22. The method according to claim 20, wherein the step of attaching the lock member to the plug comprises radially slidingly receiving the lock member in an opening attached to the plug.

23. The method according to claim 18, further comprising the steps of permitting fluid pressure to be applied to the wellhead, and activating the interlock in response to the fluid pressure to thereby prevent removal of the plug from the wellhead.

24. The method according to claim 23, wherein the step of activating the interlock comprises displacing an activation member of the interlock to thereby cause displacement of a lock member of the interlock.

25. The method according to claim 24, wherein the step of activating the interlock further comprises displacing the lock member into engagement with a recess formed internally on a fluid conduit attached to the wellhead.

26. The method according to claim 25, wherein the step of displacing the lock member further comprises axially displacing the activation member to thereby cause an external surface of the activation member to contact and radially outwardly displace the lock member into engagement with the recess.

27. A method of preventing disassembly of an assembly of multiple members included in a fluid pressure-containing housing structure, the method comprising the steps of:

providing an activator member;

providing an engagement member;

attaching the engagement member to one of the housing structure multiple members;

attaching the housing structure externally to a wellhead;

displacing the activator member in response to a difference between fluid pressure within the housing structure and fluid pressure external to the housing structure; and displacing the engagement member in response to displacement of the activator member, thereby engaging the engagement member with another one of the housing structure multiple members.

28. The method according to claim 27, wherein the engagement member displacing step further comprises preventing displacement of the one of the housing structure multiple members relative to the another one of the housing structure multiple members by the engagement of the engagement member with the another one of the housing structure multiple members.

29. The method according to claim 27, wherein the step of attaching the engagement member comprises preventing axial displacement of the engagement member by installing the engagement member in an aperture attached to the one of the housing structure multiple members.

30. The method according to claim 27, wherein in the step of attaching the engagement member, the one of the housing structure multiple members is a plug, and wherein in the step of displacing the engagement member, the another one of the housing structure multiple members is a fluid conduit in which the plug is sealingly engaged.

31. The method according to claim 27, wherein the step of displacing the activator member further comprises projecting the activator member through the housing structure.

32. The method according to claim 27, wherein the step of displacing the engagement member comprises radially outwardly displacing the engagement member at least partially into a recess formed internally on the another one of the housing structure multiple members.

33. A method of connecting an item of equipment to a wellhead, the method comprising the steps of:

providing a fluid conduit;

attaching the fluid conduit externally to the wellhead;

providing a plug capable of preventing fluid flow through the fluid conduit;

providing an interlock capable of engaging the fluid conduit;

assembling the plug to the interlock;

connecting the assembled plug and interlock to the fluid conduit, the plug thereby preventing fluid flow through the fluid conduit;

permitting fluid pressure to be applied to the fluid conduit; and activating the interlock in response to fluid pressure in the fluid conduit greater than fluid pressure external to the wellhead to thereby prevent displacement of the plug relative to the fluid conduit.

34. The method according to claim 33, further comprising the step of deactivating the interlock to thereby permit displacement of the plug relative to the fluid conduit.

35. The method according to claim 34, wherein the step of deactivating the interlock comprises releasing the fluid pressure from the fluid conduit.

36. The method according to claim 34, wherein the step of deactivating the interlock comprises applying a force to an external portion of the interlock.

37. The method according to claim 34, wherein the step of deactivating the interlock comprises applying fluid pressure to a fluid port formed in the plug.

38. The method according to claim 34, further comprising the steps of removing the plug from the fluid conduit, and attaching the item of equipment to the fluid conduit.

39. A method of blocking access to a wellhead, the method comprising the steps of:

assembling a plug, an activator member and an engagement member within an external housing structure of the wellhead;

isolating the engagement member from contact with fluid within the wellhead; and displacing the activator member in response to fluid pressure within the wellhead, thereby engaging the engagement member with the housing structure and preventing removal of the plug, while the engagement member remains isolated from contact with fluid within the wellhead.

40. The method according to claim 39, wherein the displacing step further comprises radially outwardly displacing the engagement member through an opening, the opening being formed through a retainer structure attached to the plug.

41. The method according to claim 39, further comprising the step of displacing the activator member in response to fluid pressure applied externally to the wellhead and transmitted through the plug.

42. The method according to claim 41, wherein the step of displacing the activator member in response to fluid pressure applied externally to the wellhead further comprises disengaging the engagement member from the housing structure.

* * * * *